US006056585A

United States Patent [19]

Hatakeyama et al.

[11] Patent Number: 6,056,585

[45] Date of Patent: May 2, 2000

[54] QUICK CONNECTOR AND QUICK CONNECTOR ASSEMBLY

[75] Inventors: Toshihiro Hatakeyama, Tokyo; Iwao Nishimura; Koji Ito, both of Goshogawara, all of Japan

[73] Assignee: Kyoshin Kogyo Co., Ltd., Tokyo, Japan

[21] Appl. No.: 09/076,809

[22] Filed: May 13, 1998

[30] Foreign Application Priority Data

Jan. 16, 1998 [JP] Japan ..... 10-006796

[51] Int. Cl.[7] ..... H01R 4/24

[52] U.S. Cl. ..... 439/441

[58] Field of Search ..... 439/439, 440, 439/441

[56] References Cited

U.S. PATENT DOCUMENTS 4,738,634 4/1988 Taylor et al. ..... 439/441
4,978,315 12/1990 Edgley et al. ..... 439/441
5,449,300 9/1995 Yoon ..... 439/441
5,494,456 2/1996 Kozel et al. ..... 439/441
5,915,991 6/1999 Roman ..... 439/441

*Primary Examiner*—Michael L. Gellner
*Assistant Examiner*—Barry M. L. Standig

[57] ABSTRACT

A quick connector includes a contact and a housing fitted thereon. The contact has a first contact piece, a second contact piece which cooperates with the first contact piece to hold a core wire of an electric wire, and leg portions which are electrically connected and mechanically fixed to a circuit board. The housing has a top wall thereof formed with a core-wire insertion hole and rod insertion holes, and a peripheral wall thereof defining therein an accommodation space in which the first and second contact pieces are closely received. The quick connector permits easy insertion of an electric wire thereinto, and adequately maintains electrical connection between itself and an electric wire inserted thereinto. The holding of the electric wire can be released by inserting a releasing rod into either one of the rod insertion holes. The quick connector is suitable to be automatically installed onto a circuit board.

12 Claims, 10 Drawing Sheets

QUICK CONNECTOR AND QUICK CONNECTOR ASSEMBLY

BACKGROUND OF THE INVENTION

1. Technical Field

The present invention relates to a quick connector adapted for insertion of a wire through which electrical connection is established between conduction paths formed in the same circuit board or different circuit boards or between a conduction path and a circuit component mounted on a circuit board which is the same as or different from a circuit board formed with the conduction path, and more particularly, to a quick connector arranged for easy insertion of a wire thereinto and adapted to securely hold the thus inserted wire and to release the wire holding state with ease, and a quick connector assembly suited to automatic insertion of a quick connector of this type into a circuit board by means of an automatic loader.

2. Related Arts

In constructing an electric circuit of electric equipment, a circuit board such as a printed circuit board is used intensively. In the case of using a printed circuit board to constitute an electric circuit, various electric circuit component parts are mounted on a printed circuit board formed with a conduction pattern. In an electric equipment comprised of printed circuit boards, a circuit component part mounted in a printed circuit board is sometimes required to be electrically connected to a specific portion of a conduction pattern formed in another printed circuit board. In such a case, the circuit component is generally connected with the specific portion of the conductor pattern through an electric wire extending from the circuit component, by inserting a terminal end of the wire into a connector mounted in advance on the specific portion of the conduction pattern.

As a connector of this type, a quick connector has been known which has one or more connector components which are resin-molded into one piece. This quick connector is advantageous in that electric connection can be easily established between a conduction pattern and an electrical circuit component by simply inserting an electric wire into the connector component concerned, thereby improving the efficiency in assembling mass-produced electric equipment.

However, it is difficult to use an automatic loader in mounting the quick connectors on a printed circuit board, so that the connectors are usually mounted thereon manually. Such manual work lowers the efficiency of assemblage of electric equipment which includes quick connectors of this kind. Moreover, the quick connector which requires resin molding is high-priced.

SUMMARY OF THE INVENTION

An object of the present invention is to provide a low-priced quick connector which permits easy insertion of an electric wire thereinto, adequately maintains electric connection between the once inserted electric wire and the connector, and easily releases the electric connection once established therebetween.

Another object of the present invention is to provide a quick connector assembly suited to automatic installation of quick connectors on a circuit board.

According to one aspect of the present invention, there is provided a quick connector which comprises a contact and a housing mounted on the contact. The contact includes a first contact piece, a second contact piece which cooperates with the first contact piece to hold an electric wire, and a leg portion adapted to be electrically and mechanically connected with a circuit board. The housing includes a top wall thereof formed with a first insertion hole into which the electric wire is inserted and a second insertion hole into which a releasing member is inserted, and a peripheral wall thereof cooperating with the top wall to define an accommodation space which closely receives at least those portions of the first and second contact pieces which are disposed on a side remote from the leg portion.

With the quick connector constructed as mentioned above, when an electric wire is inserted into the first insertion hole formed in the top wall of the housing of the connector mounted on a circuit board, the electric wire is held between the first and second contact pieces of the contact, to thereby establish electric connection between the contact and the electric wire so that the electric wire is electrically connected with the circuit board. In a state where the housing is attached to the contact, at least those portions of the first and second contact pieces which are disposed on the side remote from the leg portion of the contact are closely received in the accommodation space of the housing, whereby a movement of each contact piece in the direction away from the other contact piece is restricted by the housing. This makes it possible to adequately maintain electric connection established between the contact and the electric wire. When a releasing member is inserted into the second insertion hole after the electric connection is once established, the holding of the electric wire by means of the first and second contact pieces is released, so that the electric wire is permitted to be pulled out of the connector with ease.

Preferably, the first contact piece is disposed such that at least part of the first contact piece faces at least part of the second contact piece in a depth direction of the connector. The second insertion hole is aligned with the first insertion hole in the depth direction of the connector.

With this preferred connector arrangement, the holding of the electric wire by means of the first and second contact pieces is released by simply separating the first and second contact pieces from each other by a distance which is slightly larger than the outer diameter of the electric wire. In other words, the diameter of the second insertion hole can be minimized, making the connector compact in size.

More preferably, the first contact piece has a main portion thereof extending along a first peripheral wall portion (e.g., a front wall) of the peripheral wall of the housing, and a first wire holding portion thereof extending at an acute angle from an end of the main portion on a side close to the top wall of the housing toward the second contact piece. The second contact piece has a second wire holding portion thereof extending along a second peripheral wall portion (e.g., a rear wall) which faces the first peripheral wall portion in the depth direction of the connector. When the first and second contact pieces are in a free state, a distal end of the first wire holding portion is in contact with the second wire holding portion.

With this preferred arrangement, the electric wire inserted in between the first and second wire holding portions can be securely held by means of a spring force of the first contact piece. Further, by inserting a releasing member into the second insertion hole, the first wire holding portion can be easily separated from the second wire holding portion against a spring force of the first contact piece. Moreover, the first and second contact pieces, especially, the second contact piece, can be made simple in shape, so that the fabrication of these contact pieces can be simplified, thereby reducing fabrication costs.

Preferably, the accommodation space includes a first space portion for receiving that portion of the first contact piece at which the main portion is connected with the first wire holding portion of the first contact piece, and a second space portion for receiving the second wire holding portion of the second contact piece.

With this arrangement, the first and second contact pieces are held in their places within the accommodation space, whereby the holding of the electric wire by means of these contact pieces can be established and released properly.

Preferably, the leg portion extends in a longitudinal direction of the connector from an intermediate part of the contact as viewed in the depth direction of the connector. The first and second contact pieces have a first and second horizontal portions, respectively. These horizontal portions extend in the depth direction of the connector from the leg portion of the contact toward the first and second peripheral wall portions of the housing, respectively. The accommodation space closely receives the first and second horizontal portions.

With this arrangement, the circuit-board side of the accommodation space is closed by means of the first and second horizontal portions. Thus, even if electric wire chippings are produced when the electric wire is inserted in between the first and second contact pieces or when the electric wire is pulled, the electric wire chippings are prevented from falling onto the circuit board, thereby preventing a short circuit, attributable to the electric wire chippings, of conduction paths formed in the circuit board.

Preferably, the electric wire is comprised of a covered wire having a core wire covered by a sheath. The first insertion hole permits the core wire of the covered wire to pass therethrough. The top wall of the housing is formed with a guide hole in alignment with the first insertion hole, the guide hole permitting the covered wire to pass therethrough.

With this arrangement, the electric wire can be easily and accurately inserted into the first insertion hole with the aid of a guide function of the guide hole.

Preferably, the main portion of the first contact piece has an engagement piece which extends from the main portion obliquely outwardly. The first peripheral wall portion of the housing is formed with a slit which extends in the longitudinal direction of the connector. The slit has a closed end thereof located on a side away from the top wall of the housing. When the contact is received in the accommodation space of the housing, a distal end of the engagement piece of the first contact piece is in contact with the closed end of the slit.

With this arrangement, when the housing is attached to the contact, the engagement piece of the contact is brought in engagement with the closed end of the slit formed in the peripheral wall of the housing, whereby the contact is prevented from being detached from the housing.

According to another aspect of the present invention, there is provided a quick connector assembly which comprises a mount base formed with plural holes which are arranged at a regular interval and into which feed pawls of an automatic loader are adapted to be individually engagedly fitted, and a plurality of quick connectors which are mounted on the mount base at the same interval as the regular interval at which the plural holes are arranged. Each of the quick connectors is configured as mentioned above in respect of the first aspect of the invention.

The leg portion of the contact can be so configured as to be inserted into a through hole formed in a circuit board, whereby a quick connector suitable for automatic installation, by means of an automatic loader, onto the circuit board can be obtained. With use of an automatic loader mounted with a quick connector assembly which includes quick connectors of the above-mentioned types, the connector mounting can be automated by separating each quick connector from the quick connector assembly and mounting the same onto a circuit board, whereby the mounting work can be made efficiently.

DETAILED DESCRIPTION

With reference to the appended drawings, a quick connector and a quick connector assembly according to an embodiment of the present invention will be explained.

Figure 1:
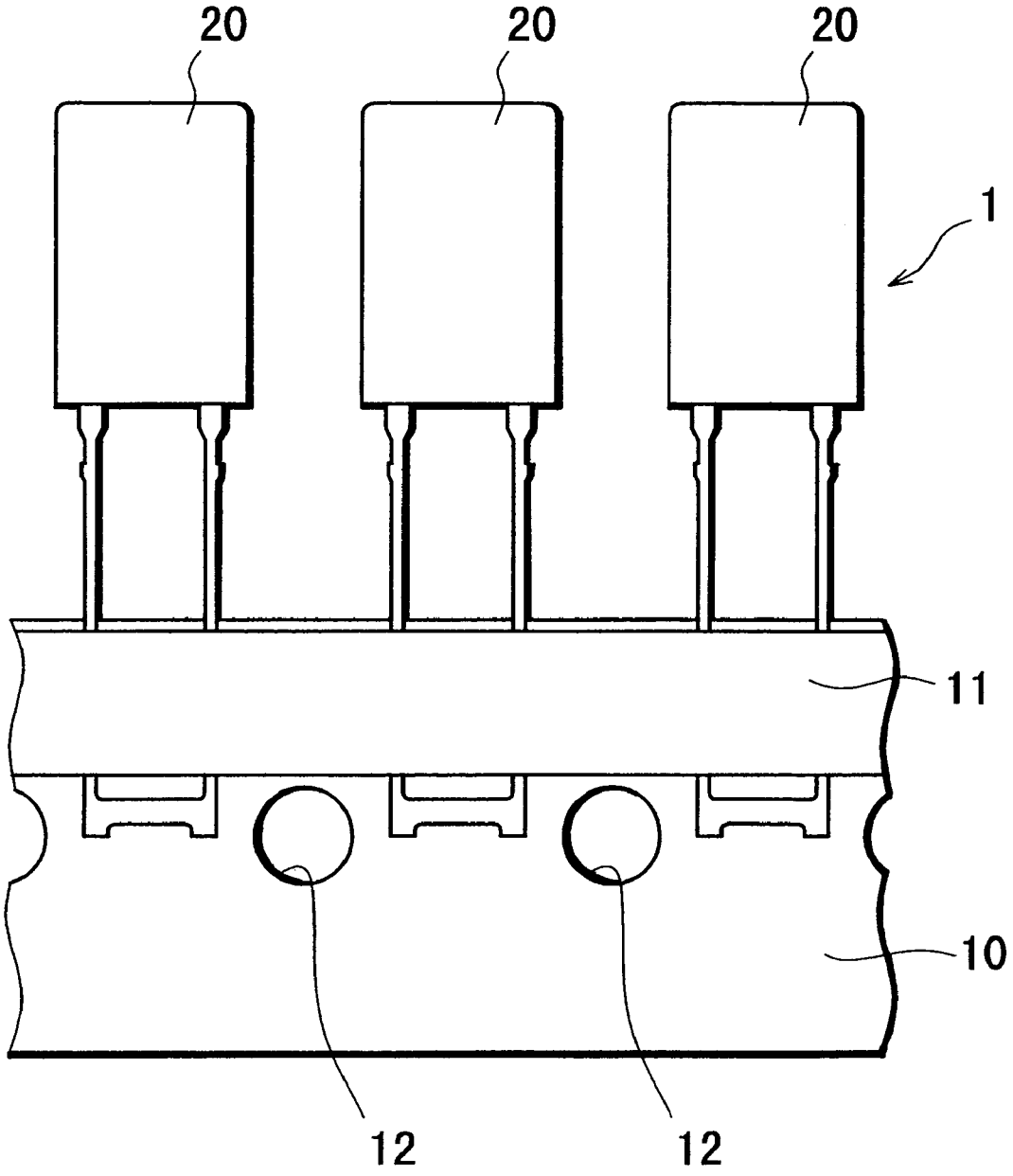
FIG. 1 is a fragmentary front view showing a quick connector assembly according to an embodiment of the present invention.
Figure 2:
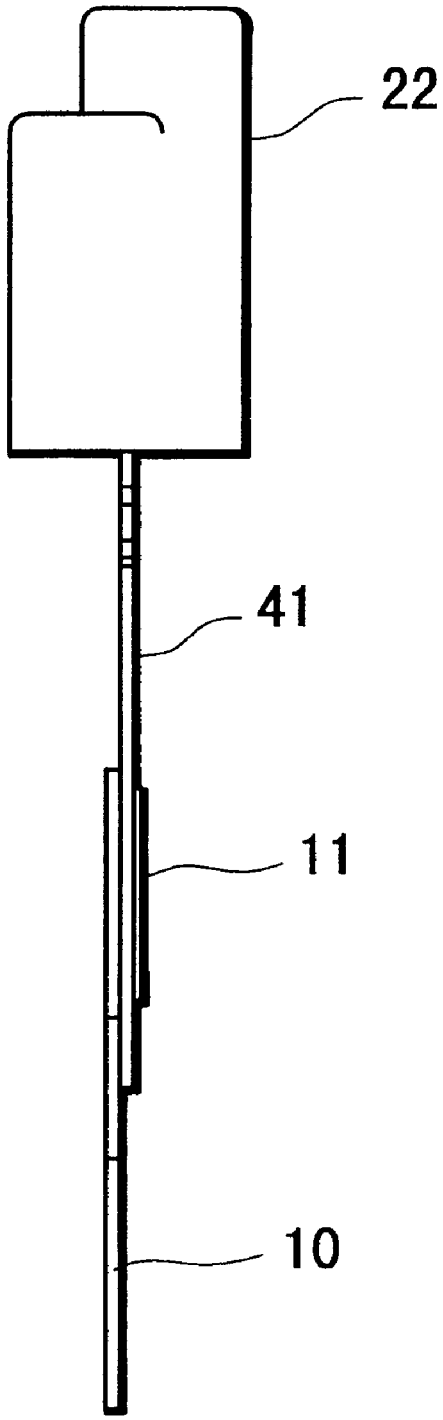
FIG. 2 is a side view of the connector assembly shown in FIG. 1.
Figure 3:
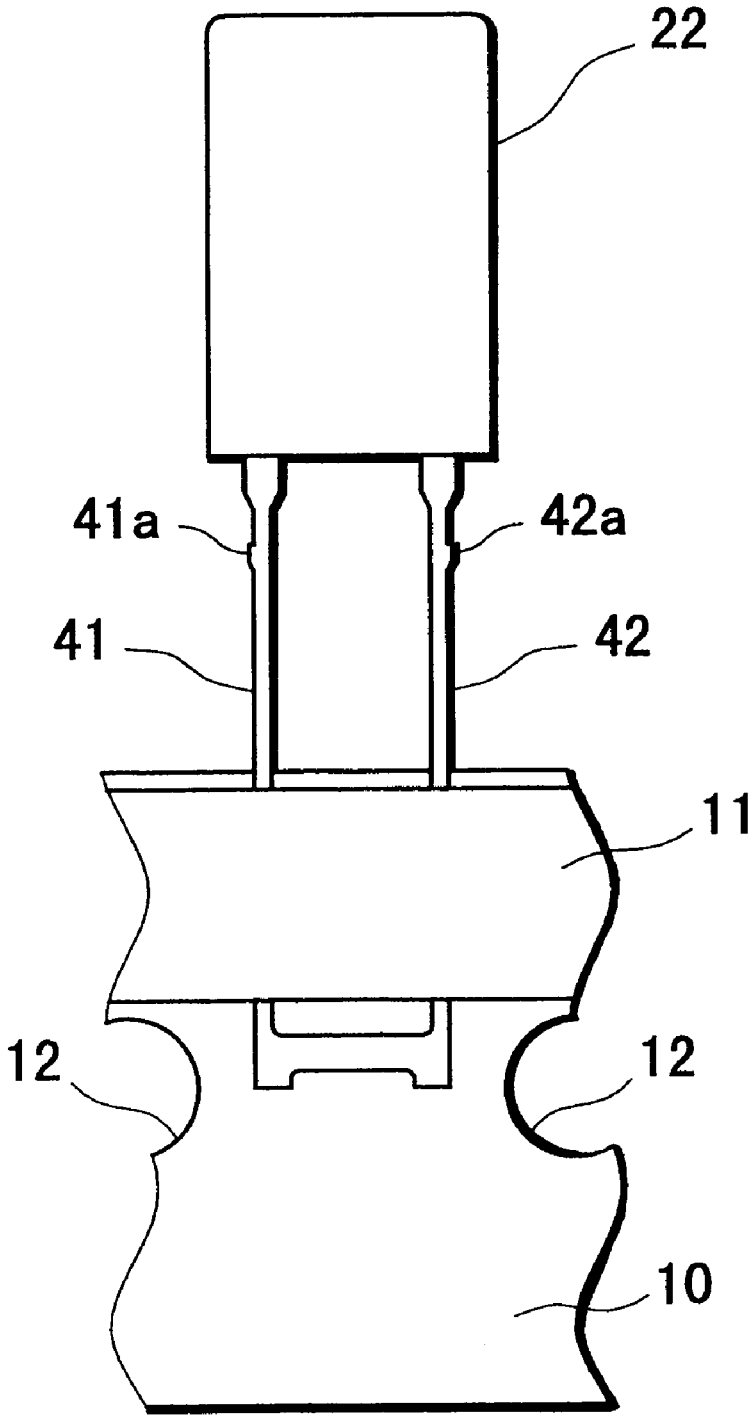
FIG. 3 is a fragmentary enlarged front view of the connector assembly shown in FIG. 1.

Referring to FIGS. 1 through 3, the quick connector assembly 1 comprises a mount base 10 and a number of quick connectors 20 which are separate from the mount base. The mount base 10 is formed, at a regular interval, with a number of perforations (sprocket holes) 12 into which feed pawls of a sprocket of an automatic connector loader (not shown), comprised of, e.g., a commercially available automatic electric component loader, are engaged. With the rotation of the sprocket, the connector assembly 1 mounted in the automatic loader is transferred. The connectors 20 are affixed, by means of a tape 11, to the mount base 10 at the same interval as the interval at which the perforations are spaced from one another.

Each connector 20 of the connector assembly 1 is connected and secured to a conductor path, not shown, provided in a circuit board 13 (e.g., a conductor pattern formed in a printed circuit board), as shown in FIGS. 9 through 12, so that an electric wire 23 inserted into the connector 20 is electrically connected with the conductor path through the connector.

Figure 13:
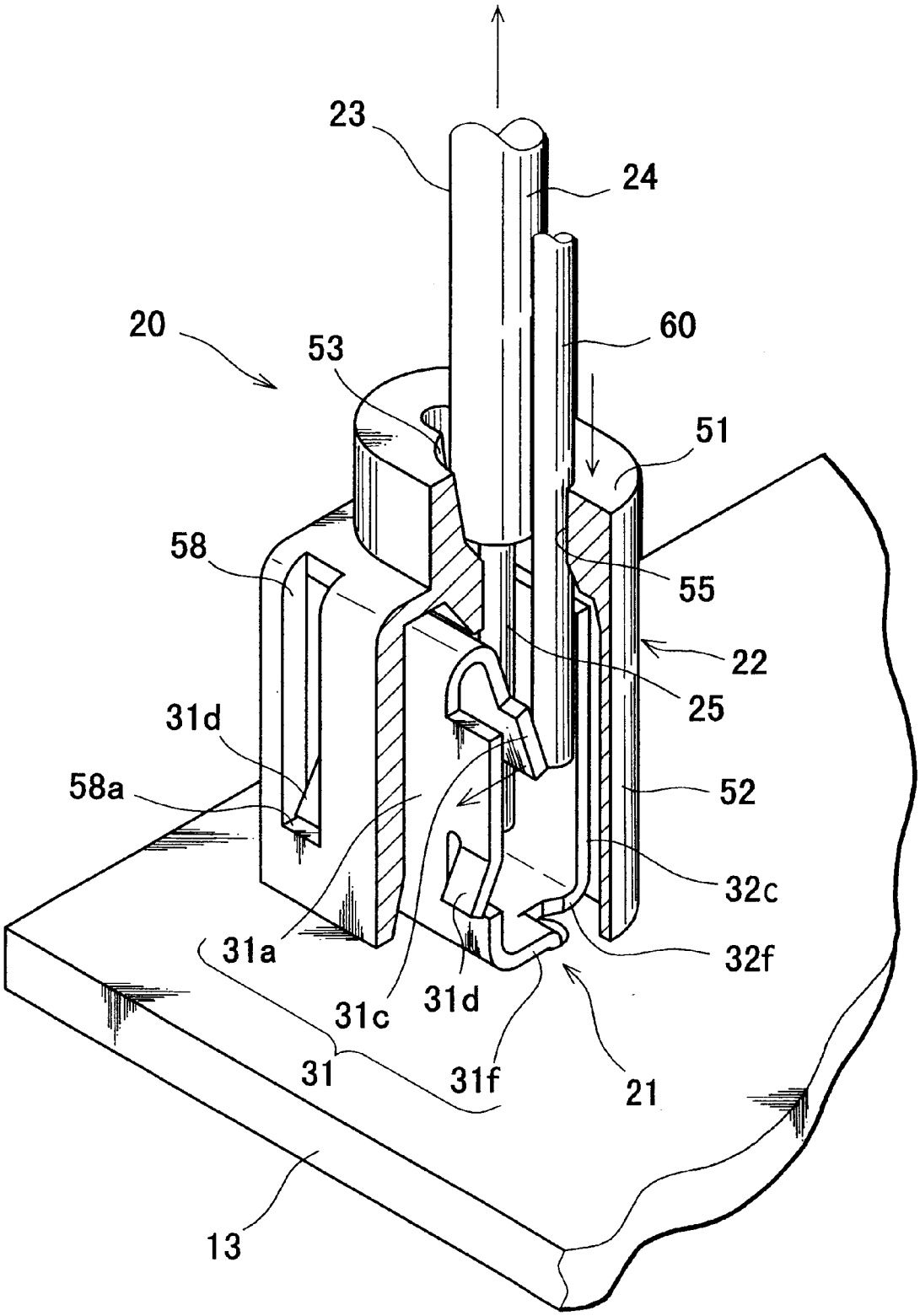
FIG. 13 is a perspective view showing, partly broken, the quick connector in a state where a releasing rod is inserted into the connector.

As shown in FIG. 13, each of the connectors 20 has a contact 21 thereof electrically connected to and mechanically fixed to the circuit board 13, and a housing 22 for receiving most parts of the contact 21.

Figure 4:
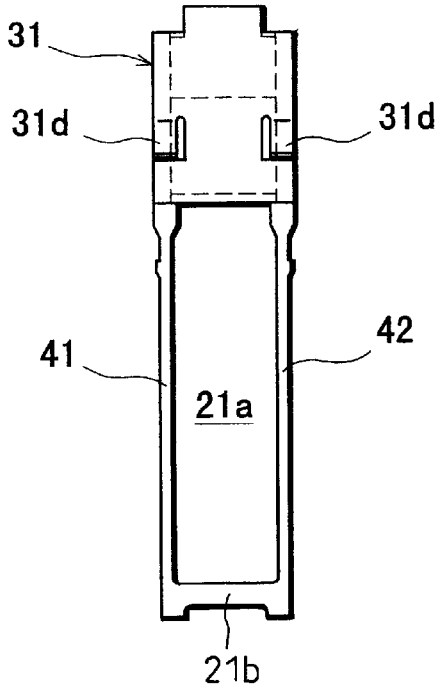
FIG. 4 is a front view showing a contact, which is a primary element of the quick connector shown in FIGS. 1 through 3, in a state that the contact is provided with a coupling portion through which first and second leg portions are coupled to each other.
Figure 5:
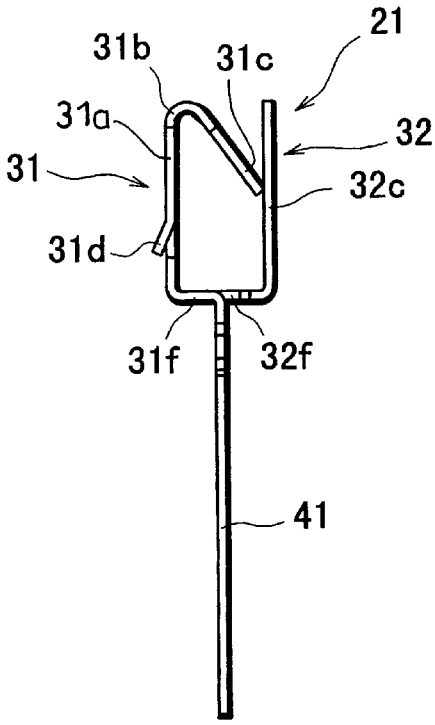
FIG. 5 is a side view of the contact shown in FIG. 4.

As shown in FIGS. 4 and 5, the contact 21 has first and second contact pieces 31, 32 and first and second leg portions 41, 42. Preferably, the contact 21 is obtained from a single metal sheet by subjecting this sheet to a forming process. The second contact piece 32 is comprised of part of a sheet portion (indicated by reference numeral 21*a* in FIG. 4), defined by the first contact piece 31, the first and second leg portions 41, 42, and a coupling portion 21*b* of the metal sheet.

Figure 9:
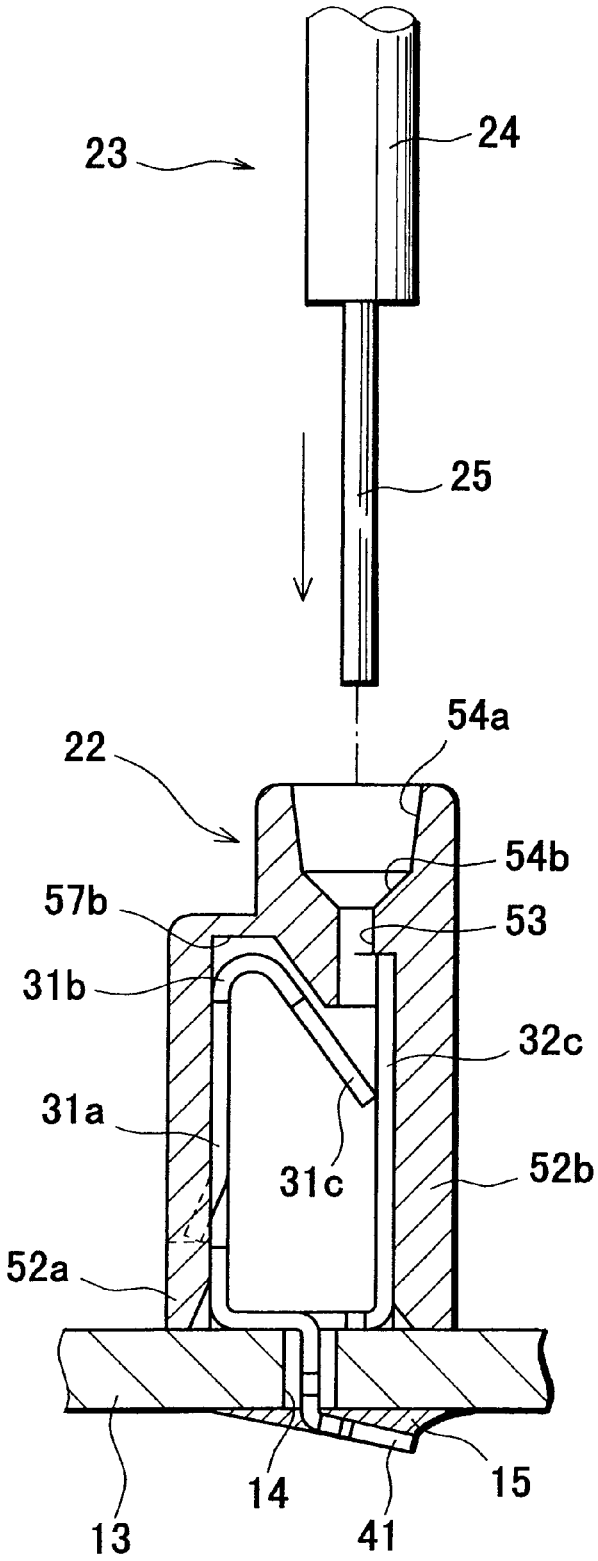
FIG. 9 is a fragmentary sectional side view showing the quick connector in a state where it is mounted on a circuit board.
Figure 10:
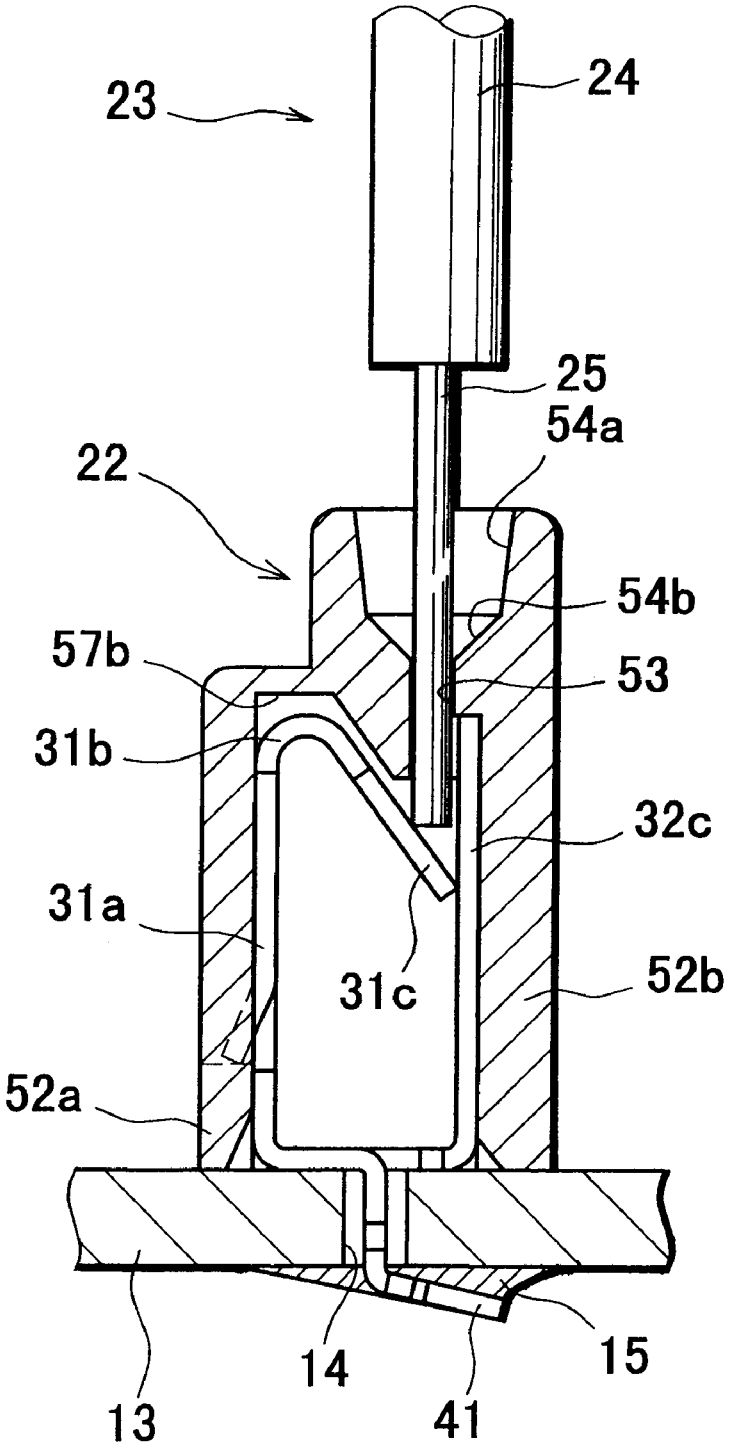
FIG. 10 is a fragmentary sectional side view showing the quick connector in a state where an electric wire is being inserted into the connector.
Figure 11:
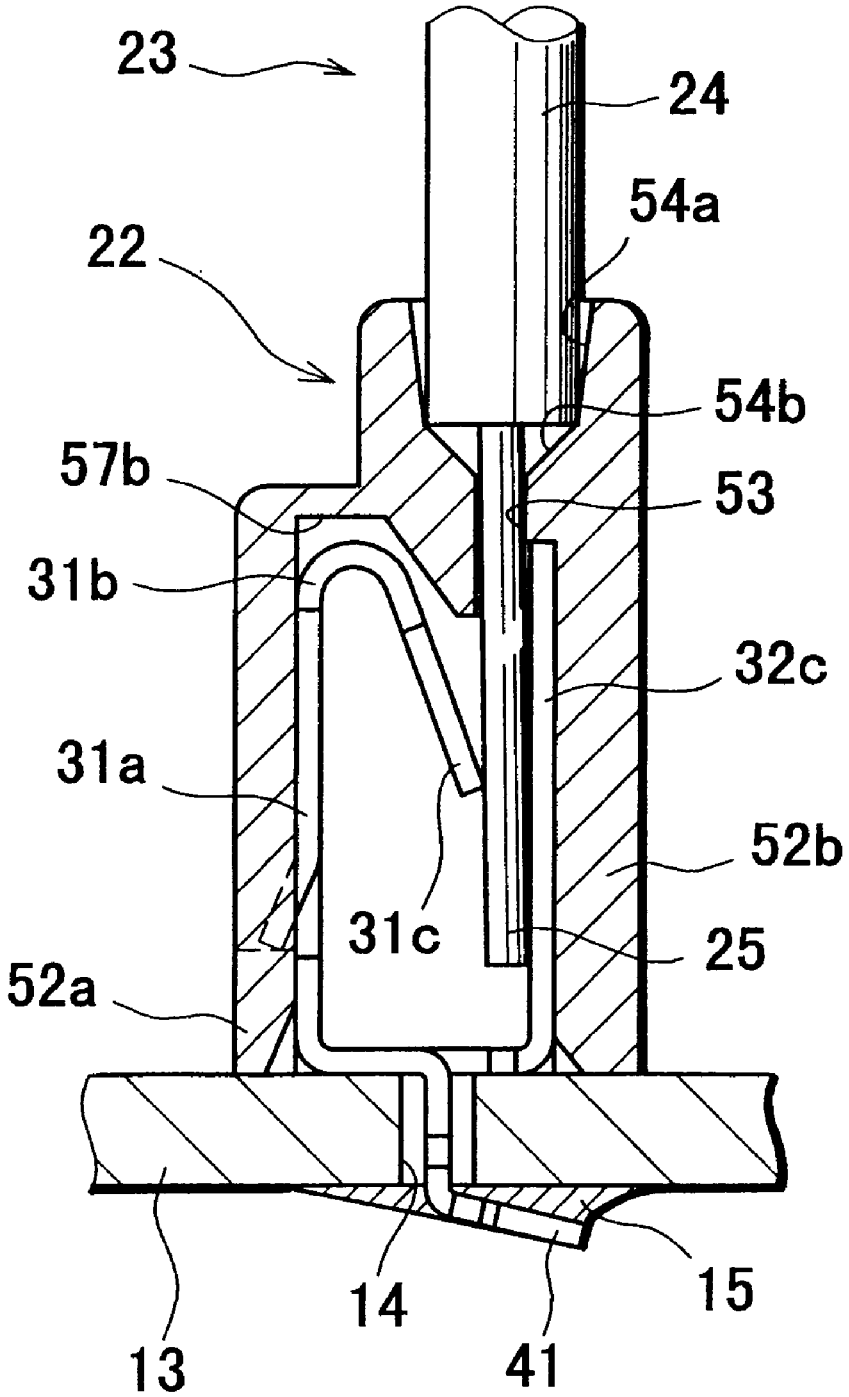
FIG. 11 is a fragmentary sectional side view showing the quick connector in a state where an electric wire is inserted into the connector.

The first and second leg portions 41, 42 extend downward in the longitudinal direction of the connector from lower ends of widthwise edges of the first contact piece 31, respectively (FIG. 4). As viewed in the depth direction of the connector (FIG. 5), these two leg portions extend along the longitudinal axis of the connector. As shown in FIGS. 9 through 11, the first and second leg portions 41, 42 are adapted to be inserted into two through holes (one of which is shown by reference numeral 14) formed separately in the print circuit board 13, respectively. The first and second leg portions 41, 42 are formed into, e.g., a rectangular shape in cross section, and the through hole 14 of the print circuit board 13 is preferably comprised of a round-hole. The first and second leg portions 41 and 42 are integrally formed with stopper knots 41*a* and 42*a* (FIG. 3), respectively, which project outward in the width direction of the connector.

The first contact piece 31 has a horizontal portion 31*f* thereof extending, as viewed in the depth direction of the connector, from housing-side ends of the leg portions 41, 42 toward a front wall (first peripheral portion), shown by reference numeral 52*a* in FIG. 9, of the housing. This contact piece 31 further includes a main portion 31*a* thereof extending from the outer end, as viewed in the depth direction of the connector, of the horizontal portion 31*f* toward a top wall 51 of the housing in the connector height direction (or in the longitudinal direction of the connector) along the front wall 52*a* of the housing. Moreover, the first contact piece 31 includes a bent portion 31*b* thereof extending at an acute angle from the main portion 31*a*, and a core-wire holding portion (more generally, a wire holding portion) 31*c* thereof extending from an end, on the side remote from the main portion 31*a*, of the bent portion 31*b* toward the second contact piece 32. These elements 31*f*, 31*a*, 31*b* and 31*c* of the first contact piece 31 are formed into one piece.

The main portion 31*a* of the first contact piece 31 has two engagement pieces 31*d* which extend obliquely and outwardly from the main portion 31*a* to the side remote from the top wall 51 of the housing. These engagement pieces 31*d* are formed by raising associated cut parts of the main portion 31*a* of the contact.

The second contact piece 32 has a horizontal portion 32*f* thereof extending in the direction away from the horizontal portion 31*f* of the first contact piece 31, that is, extending toward a rear wall (second peripheral wall portion), shown by reference numeral 52*b* in FIG. 9, of the housing, as viewed in the depth direction of the connector. This contact piece 32 further includes a core-wire holding portion 32*c* thereof formed integrally with the horizontal portion 32*f* and extending in parallel with the main portion 31*a* of the first contact piece 31 and along the rear wall 52*b* of the housing.

The core-wire holding portion 31*c* of the first contact piece 31 has its distal end which is in contact with the inner face of an intermediate portion of the core-wire holding portion 32*c* of the second contact piece 32 when the first and second contact pieces are in their free states. As shown in FIG. 11, the distal end of the core-wire holding portion 31*c* cooperates with another core-wire holding portion 32*c* to hold the core wire 25 of the electric wire 23. In FIG. 11, reference numeral 24 denotes a sheath which covers the core wire 25.

Figure 6:
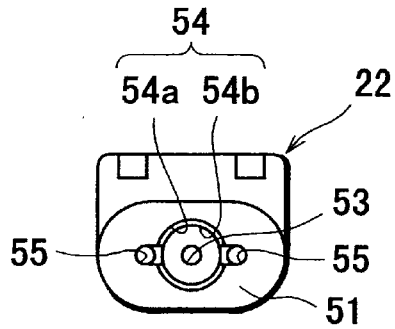
FIG. 6 is a top view of the housing which is a primary element of the quick connector shown in FIGS. 1 through 3.
Figure 7:
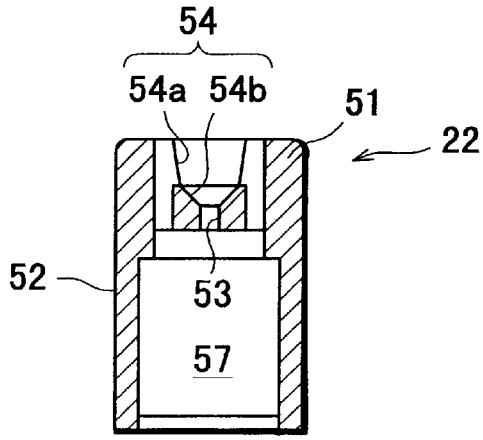
FIG. 7 is a sectional front view of the housing shown in FIG. 6.
Figure 8:
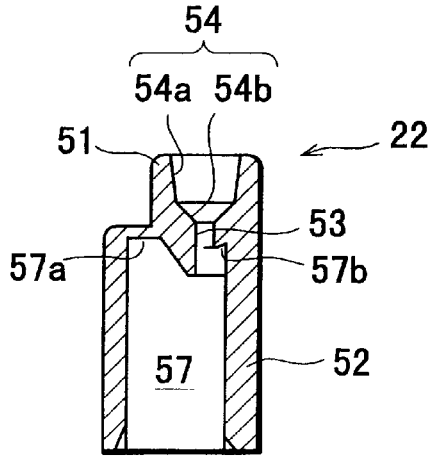
FIG. 8 is a sectional side view of the housing shown in FIGS. 6 and 7.

The housing 22 is obtained by injection-molding synthetic resin, for instance, and has the above-mentioned top wall 51 and a peripheral wall 52, as shown in FIGS. 6 through 8.

The top wall 51 of the housing is formed with a core-wire insertion hole (more generally, a wire insertion hole) 53 which extends along the longitudinal axis of the connector and into which the core wire 25 of the electric wire 23 is inserted. This core-wire insertion hole (first insertion hole) 53 is provided at a center position in the width direction of the connector, as shown in FIG. 7, and at a position deviated toward the second contact piece 32 in the depth direction of the connector, as shown in FIGS. 8 through 12. The insertion hole 53 has a diameter which is slightly larger than the outer diameter of the core wire 25.

Further, the top wall 51 is formed, in alignment with the core-wire insertion hole 53, with a guide hole 54 into which the covered wire 23 is inserted. The guide hole 54 is comprised of a first tapered hole 54*a* which opens to the top surface of the housing 22, and a second tapered hole 54*b* which communicates with the first tapered hole 54*a* and the core-wire insertion hole 53. As shown in FIG. 11, at the boundary between the first and second tapered holes 54*a* and 54*b*, the guide hole 54 has an inner diameter which is substantially the same as the outer diameter of the electric wire 23.

The top wall 51 of the housing is formed with two rod insertion holes (second insertion holes) 55 extending in the vertical direction of the connector. Each of the rod insertion holes 55 permits a releasing rod (releasing member) 60 to pass therethrough. As shown in FIG. 6, the rod insertion holes 55 are provided in alignment with the core-wire insertion hole 53 in the depth direction of the connector and are positioned adjacent to the core-wire insertion hole 53 and the guide hole 54 as viewed in the width direction of the connector. The rod insertion holes 55 each have a diameter slightly larger than the outer diameter of the core wire 25.

The top and peripheral walls 51, 52 of the housing define therein an accommodation space 57 which preferably closely receives the first and second contact pieces 31, 32. In the accommodation space 57, reference numeral 57*a* denotes a first space portion, defined by the top and front walls 51, 52*a* of the housing, for receiving the bent portion 31*b* of the first contact piece 31, and reference numeral 57*b* denotes a second space portion formed in the rear wall of the housing for receiving the entire of the core-wire holding portion 32*c* of the second contact piece 32. When the housing 22 is attached to the contact 21, the contact pieces 31 and 32 are closely received in the accommodation space 57 so that each contact piece is prevented from moving in the direction away from the other contact piece, whereby the holding of the core wire by means of the first and second contact pieces can be securely maintained. The side of the accommodation space 57 close to the printed circuit board 13 is closed by the horizontal portions 31*f*, 32*f* of the first and second contact pieces 31, 32. Thus, even if electric wire chippings are produced when the core wire 25 is inserted in between the first and second contact pieces 31, 32 or when the electric wire 23 is pulled, the electric wire chippings are prevented from falling onto the printed circuit board 13.

The front wall of the housing is formed with two slits 58 which extend in the height direction of the connector. These slits 58 each have a closed end 58*a* thereof located on the side remote from the top wall of the housing, and another end thereof opening to the top surface of the housing (FIG. 13). When the contact 21 is received in the accommodation space 57 of the housing 22, a distal end portion of an engagement piece 31*d* formed in the contact 21 is disposed in the slit 58, with the distal end of the engagement piece 31*d* brought in contact with the closed end 58*a* of the slit 58, whereby the contact 21 is prevented from being detached from the housing 22.

In manufacturing the connector assembly 1 having the construction described above, contacts 21 obtained from a metal sheet, not shown, are arranged on the mount base 10 at the same intervals as perforation intervals L in a such manner that each contact 21 is situated halfway between each two adjacent perforations 12 which are bored through the mount base 10, as shown in FIG. 1. Then, respective leg portions of these contacts 21 are stuck to the mount base 10 by means of an adhesive tape 11. Finally, a housing 22 is fitted on each contact 21, whereby a plurality of connectors 20 (FIG. 1) which are coupled to one another through the mount base 10 is obtained. When the housing 22 is attached to the contact 21, the engagement piece 31 of the contact is engaged with the closed end 58*a* of the slit 58 formed in the peripheral wall of the housing, thereby preventing the housing from being detached from the contact (FIG. 13).

In mounting the connectors 20 on the printed board, the perforations 12 of the mount base 10 of the connector assembly 1 are caused to engage the feed pawls of the sprocket of the automatic loader, and the loader is then actuated to rotate the sprocket. By doing this, the assembly 1 is transported to the position where its leading connector 21 faces a chuck (not shown) of the loader. After the leading connector 21 is held by the chuck, the chuck is moved so that the connector assembly 1 is delivered to the position where it faces a cutter (not shown) of the loader. Then, the connector assembly 1 is cut along the boundary between the leading connector 20 and its subsequent one by means of the cutter, whereby a combination of the leading connector 20 and the mount base associated therewith is separated from the connector assembly 1. After the chuck is horizontally turned to rotate the combination through 90 degrees around the cutter, a coupling portion 21*b* is cut off from the connector 21 by means of the cutter.

Subsequently, the chuck is moved to locate the connector 20 in a position such that its leg portions 41 and 42 face through holes 14 of the printed board 13, respectively. Thereafter, the chuck is moved so that the leg portions are inserted individually into the through holes. After the chuck is released so that the connector 20 is disengaged from the chuck, the connector 20 is pressed by means of a pusher (not shown) of the automatic loader so that the leg portions 41 and 42 are further pushed into their corresponding through holes 14. By doing this, the bottom surface of the housing 22 of the connector 20 and the bottom surfaces of the horizontal portions 31*f* and 32*f* of the connector pieces 31 and 32 are caused to abut against the upper surface of the printed circuit board 13. Then, extra parts of the leg portions 41 and 42 are cut off, and the respective distal end portions of the leg portions 41 and 42 which project from the printed circuit board 13 are clinched. Thereupon, automatically loading the printed circuit board 13 with the leading connector 20 is finished.

As in the case of the leading connector 20, the printed circuit board 13 is automatically loaded with the subsequent connectors 20. Then, the leg portions 41 and 42 of each connector 20 are connected electrically and mechanically fixed to the conductor pattern of the printed circuit board 13 by flow soldering using a molten solder bath, as shown by reference numeral 15 in FIG. 9. The holes 14 of the printed circuit board 13 into which the leg portions 41 and 42 of the connector 20 are inserted are formed separately from one another, so that they have a small diameter. Even if the printed circuit board 13 is subjected to an external force during operation, it is less likely to be damaged. Moreover, each leg portion 41 or 42 has a narrow cross section and hence a small thermal capacity, so that the flow soldering can be carried out properly. Since the leg portions 41 and 42 of the connector 20 are formed with the stopper knots 41*a* and 42*a*, respectively, they can bite solder efficiently.

Since mounting the connector 20 on the printed circuit board 13 is thus automated, the necessity of manual operation is obviated, and the cost can be reduced.

After mounting the connector 20 on the printed circuit board 13, the electric wire 23 which extends from a conduction pattern of the printed circuit board 13 or from an electrical circuit component is connected with the connector 20. On this occasion, a predetermined length of the sheath 24 at the distal end portion of the electric wire 23 is peeled off, thereby causing the core wire 25 to be bare. The core wire 25 is then caused to be inserted into the core-wire insertion hole 53 of the connector 20. The guiding function of the guide hole 54 makes it easy to insert the core wire 25 into the insertion hole 53 (FIG. 10). If the core wire 25 is caused to be inserted further, the core wire 25 advances between the first and second contact pieces 31 and 32 while pressing the core-wire holding portion 31*b* in the direction away from the core-wire holding portion 32*b* of the second contact piece 32 against a spring force of the bent portion 31*b* of the first contact piece 31. During this time, even if electric wire chippings are produced, these chippings are prevented from falling on the printed circuit board 13 since the printed circuit board-side of the contact 21 is closed by means of the peripheral wall 52 of the housing and the horizontal portions 31*f*, 32*f* of the first and second contact pieces 31, 32, whereby short-circuited failure can be prevented in advance.

Subsequently, when the distal end of the sheath 24 of the electric wire reaches the boundary between the tapered holes 54*a*, 54*b* of the guide hole 54, a further insertion of the core wire 25 is prevented so that the core-wire insertion is completed. The main portion 31*a* of the first contact piece 31 and the core-wire holding portion 32*c* of the second contact piece 32 are prevented from moving in the direction away from each other by means of the housing 22, and the core-wire holding portion 31*c* of the first contact piece 31 which receives a spring force of the bent portion 31*b* presses the core wire 25 toward the core-wire holding portion 32*c* of the second contact piece 32. As a result, the core wire 25 is securely held by the contact pieces 31*c* and 32*c* therebetween, whereby electrical connection between the connector 20 and the electric wire 23 is established so that the electric wire 23 is electrically connected with the printed circuit board 13 through the connector 20.

Figure 12:
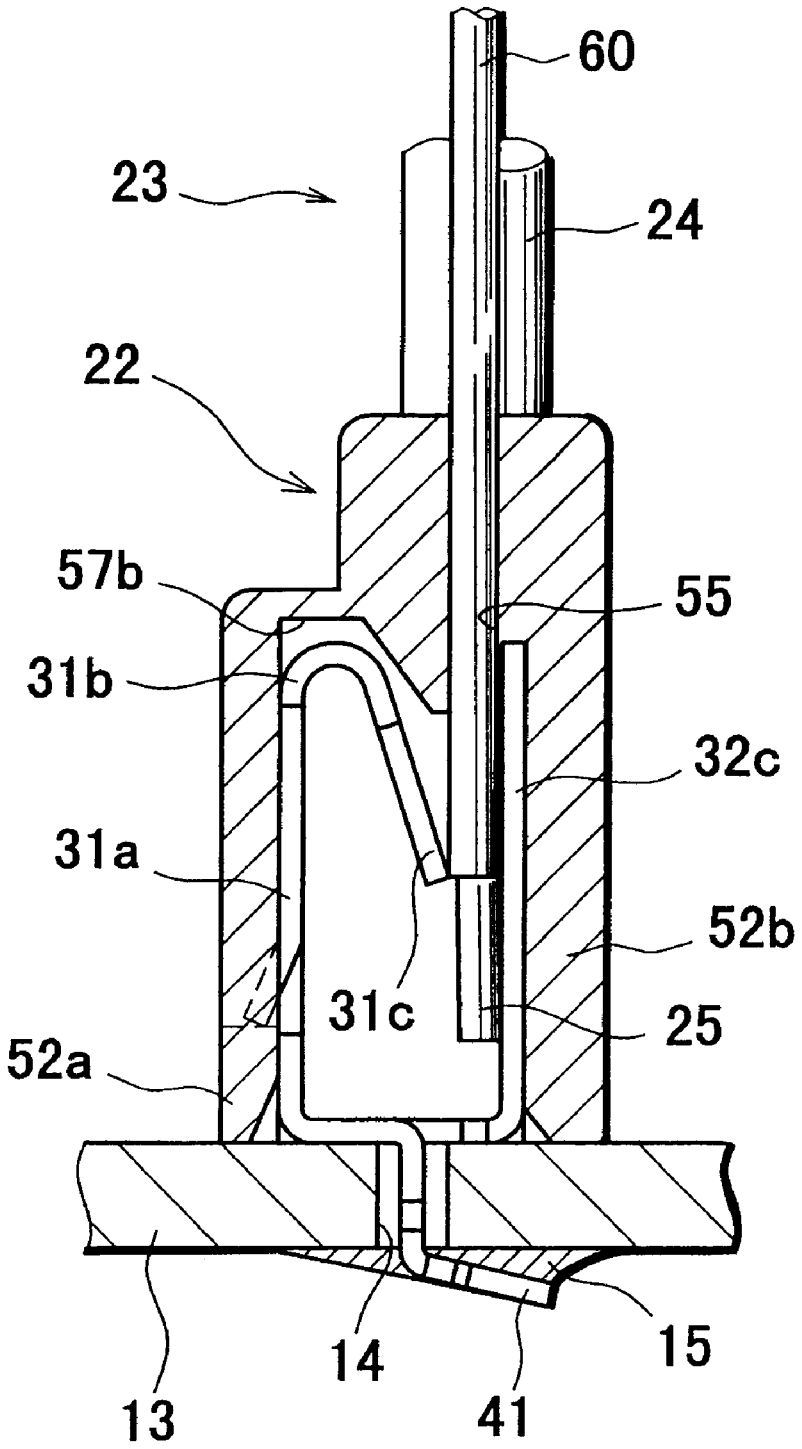
FIG. 12 is a fragmentary sectional side view showing the quick connector in a state where a releasing rod is inserted into the connector.

If the electric wire 23 is needed to be detached from the connector 20, a releasing rod 60 is inserted into either one of the two rod insertion holes 55. Alternatively, two releasing rods 60 may be inserted these two holes 55, respectively. The distal end of the releasing rod 60 inserted into the rod insertion hole 55 presses the core-wire holding portion 31*c* of the first contact piece 31 in the direction away from the core-wire holding portion 32*c* of the second contact piece 32 against a spring force of the first contact piece 31, thereby releasing the wire holding by means of these two contact pieces (FIG. 12). Upon removal of the electric wire, therefore, the electric wire 23 can be pulled out from the connector 20 after inserting the releasing rod 60 into the rod insertion hole 55 to a predetermined depth.

The quick connector and quick connector assembly of the present invention are not limited to those of the foregoing embodiment, but may be modified in various manners.

For instance, in the preferred embodiment, the second contact piece is comprised of the horizontal portion 32*f* and the core-wire holding portion 32*c* to thereby simplify the shape of the contact. Alternatively, the second contact piece may be configured to have a horizontal portion, main portion, bent portion and core-wire holding portion. In this case, the first and second contact pieces are disposed in such a manner that the distal ends of their core-wire holding portions face each other with a distance which is less than the outer diameter of the core wire 25. Further, Each of the core-wire insertion hole 53 and the rod insertion hole 55 is formed at a position such that imaginary extended line therefrom passes through the center of a gap defined between the distal ends of the core-wire holding portions.

In the embodiment, the contact is provided with two leg portions 41 and 42. Alternatively, the contact is further provided with a third leg portion located between these two leg portions. In this case, the third leg portion can be obtained by raising part of the sheet portion 21 shown in FIG. 4.

What is claimed is:

1. A quick connector, comprising:

a contact including a first contact piece, a second contact piece which contacts an electric wire at a portion opposite the first contact piece to hold the electric wire, and a leg portion adapted to be electrically and mechanically connected with a circuit board; and a housing attached to said contact, said housing including a top wall thereof formed with a first insertion hole into which the electric wire is inserted and a second insertion hole into which a releasing member is inserted, and a peripheral wall thereof cooperating with the top wall to define an accommodation space which closely received at least those portions of said first and second contact pieces which are disposed on a side remote from said leg portion;

said first contact piece being disposed such that at least part of said first contact piece faces at least part of said second contact piece in a depth direction of the connector;

said second insertion hole being aligned with said first insertion hole in the depth direction of said connector.

2. The quick connector according to claim 1, wherein said first contact piece has a main portion thereof extending along a first peripheral wall portion of said peripheral wall of said housing, and a first wire holding portion thereof extending at an acute angle from an end of said main portion on a side close to the top wall of said housing toward said second contact piece;

said second contact piece has a second wire holding portion thereof extending along a second peripheral wall portion which faces said first peripheral wall portion in the depth direction of said connector; and a distal end of said first wire holding portion is in contact with said second wire holding portion when said first and second contact pieces are in a free state.

3. The quick connector according to claim 2, wherein said accommodation space includes a first space portion for receiving that portion of said first contact piece at which the main portion is connected with the first wire holding portion of said first contact piece, and a second space portion for receiving the second wire holding portion of said second contact piece.

4. The quick connector according to claim 2, wherein said leg portion extends in a longitudinal direction of said connector from an intermediate part of said contact as viewed in the depth direction of said connector;

said first and second contact pieces have a first and second horizontal portions, respectively, these horizontal portions extending in the depth direction of said connector from said leg portion of said contact toward the first and second peripheral wall portions of said housing, respectively; and said accommodation space closely receives said first and second horizontal portions.

5. The quick connector according to claim 1, wherein the electric wire is comprised of a covered wire having a core wire covered by a sheath;

the first insertion hole permits the core wire of the covered wire to pass therethrough; and the top wall of said housing is formed with a guide hole in alignment with the first insertion hole, the guide hole permitting the covered wire to pass therethrough.

6. The quick connector according to claim 2, wherein the main portion of said first contact piece has an engagement piece which extends from the main portion obliquely outwardly;

the first peripheral wall portion of said housing is formed with a slit which extends in the longitudinal direction of said connector;

said slit has a closed end thereof located on a side away from the top wall of said housing; and said engagement piece of said first contact piece has a distal end thereof brought in contact with the closed end of said slit when said contact is received in the accommodation space of said housing.

7. A quick connector assembly, comprising:

a mount base formed with plural holes which are arranged at a regular interval and into which feed pawls of an automatic loader are adapted to be individually engagedly fitted; and a plurality of quick connectors which are mounted on said mount base at the same interval as the regular interval at which the plural holes are arranged, wherein each of said quick connectors includes:

a contact including a first contact piece, a second contact piece which contacts an electric wire at a portion opposite the first contact piece to hold an electric wire, and a leg portion adapted to be electrically and mechanically connected with a circuit board; and a housing attached to said contact, said housing including a top wall thereof formed with a first insertion hole into which the electric wire is inserted and a second insertion hole into which a releasing member is inserted, and a peripheral wall thereof cooperating with the top wall to define an accommodation space which closely received at least those portions of said first and second contact pieces which are disposed on a side remote from said leg portion;

said first contact piece being disposed such that at least part of said first contact piece faces at least part of said second contact piece in a depth direction of the connector;

said second insertion hole being aligned with said first insertion hole in the depth direction of said connector.

8. The quick connector assembly according to claim 7, wherein said first contact piece has a main portion thereof extending along a first peripheral wall portion of said peripheral wall of said housing, and a first wire holding portion thereof extending at an acute angle from an end of said main portion on a side close to the top wall of said housing toward said second contact piece;

said second contact piece has a second wire holding portion thereof extending along a second peripheral wall portion which faces said first peripheral wall portion in the depth direction of said connector; and a distal end of said first wire holding portion is in contact with said second wire holding portion when said first and second contact pieces are in a free state.

9. The quick connector assembly according to claim 8, wherein said accommodation space includes a first space portion for receiving that portion of said first contact piece at which the main portion is connected with the first wire holding portion of said first contact piece, and a second space portion for receiving the second wire holding portion of said second contact piece.

10. The quick connector assembly according to claim 8, wherein said leg portion extends in a longitudinal direction of said connector from an intermediate part of said contact as viewed in the depth direction of said connector;

said first and second contact pieces have a first and second horizontal portions, respectively, these horizontal portions extending in the depth direction of said connector from said leg portion of said contact toward the first and second peripheral wall portions of said housing, respectively; and said accommodation space closely receives said first and second horizontal portions.

11. The quick connector assembly according to claim 7, wherein the electric wire is comprised of a covered wire having a core wire covered by a sheath;

the first insertion hole permits the core wire of the covered wire to pass therethrough; and the top wall of said housing is formed with a guide hole in alignment with the first insertion hole, the guide hole permitting the covered wire to pass therethrough.

12. The quick connector assembly according to claim 8, wherein the main portion of said first contact piece has an engagement piece which extends from the main portion obliquely outwardly;

the first peripheral wall portion of said housing is formed with a slit which extends in the longitudinal direction of said connector;

said slit has a closed end thereof located on a side away from the top wall of said housing; and said engagement piece of said first contact piece has a distal end thereof brought in contact with the closed end of said slit when said contact is received in the accommodation space of said housing.

* * * * *